United States Patent [19]

Terrell

[11] 4,380,792

[45] Apr. 19, 1983

[54] PIVOT MOUNTING

[75] Inventor: Christopher Terrell, London, England

[73] Assignee: Chloride Group Limited, London, England

[21] Appl. No.: 196,829

[22] Filed: Oct. 14, 1980

[30] Foreign Application Priority Data

Apr. 3, 1980 [GB] United Kingdom ..... 8011389
Jul. 30, 1980 [GB] United Kingdom ..... 8024974

[51] Int. Cl.[3] ..... F21V 21/14

[52] U.S. Cl. ..... 362/250; 362/275; 362/283; 362/287; 362/417; 362/419; 362/426; 362/427; 362/430; 362/449

[58] Field of Search ..... 362/250, 275, 283, 287, 362/417, 419, 426, 427, 430, 449

[56] References Cited

U.S. PATENT DOCUMENTS 3,519,811 7/1970 Jacobs ..... 362/426
4,075,470 2/1978 Moore ..... 362/287

*Primary Examiner*—Stephen J. Lechert, Jr.
*Attorney, Agent, or Firm*—Oblon, Fisher, Spivak, McClelland & Maier

[57] ABSTRACT

This invention is a pivot mounting for a lamp (12) comprising a pair of journal bearings (30) and two parallel semi-circular springs (14, 16) urging the bearings towards one another, the bearings having gripping surfaces (56) for the mirror. The springs (14, 16) allow the bearings to be separated to admit the mirror which is then held by the resilience of the springs.

15 Claims, 4 Drawing Figures

PIVOT MOUNTING

This invention relates to a pivot mounting for a lamp or other component, enabling it to be easily adjusted.

There have of course been many proposals for mounting various components through pivot mountings, but they have tended to be either rather expensive, or rather unreliable, and it is an object of the present invention to provide a pivot mounting which is easy and stable to use but which is yet quite economical to produce.

According to the present invention, a pivot mounting comprises a pair of journal bearings, spring means urging them towards each other along a common journal axis, the bearings having gripping surfaces for an object to be mounted between the bearings, the bearings being capable of relative movement in the direction of the common axis against the restraint of the spring means for permitting the object to be positioned, and for then holding the object by the resilience of the spring means.

Advantageously the object which is to be pivotally mounted is a lamp or mirror.

The journal bearings may be easily assembled to pivotally mount and grip a lamp or other component solely by the action of the spring means.

Each journal bearing may comprise a pair of moulded plastics components, one of which is a journal, and one of which is a journal housing, and one of the components has means for locating one end of the spring means. The moulded plastics components are cheap and easy to produce. Preferably the plastics components include co-operating portions which limit the relative rotation of the journal and the journal housing. This is of particular use when a lamp is pivotally mounted as the leads leading to the lamp may be damaged if they are pulled by complete rotation of the lamp in the bearings.

The gripping surfaces of the bearings may be channel-shaped surfaces and they may be formed on extensions on one of the plastics components comprising the journal bearings. This is particularly advantageous when a lamp which has a circular periphery is gripped by the gripping means, as a sector of the circumferential rim of the lamp lies in the channel-shaped surface.

A cover may extend between the journal bearings. This is of particular use when a lamp is mounted in the bearings as the connections to the bulb are protected.

The spring means may be the sole means holding the bearing components and the cover assembled.

Preferably the spring means comprises one or two part-circular spring wires which act as a further pivot mounting about a second axis through the centre of the part-circles perpendicular to the plane of the part-circles. An object which is mounted by such pivot mountings, may be easily rotated about both the perpendicular axes to be orientated in a wide variety of positions.

The part-circular spring means are preferably located at the ends of a slot or guide in a supporting member with means holding the spring means against the slot or guide. An object when mounted by such a pivot means is then able to pivot by the part-circular spring means moving through the slot or groove while remaining against the ends of the slot or guide.

Various embodiments of the invention will now be described by way of example, and with reference to the accompanying drawings, in which.

Figure 1:
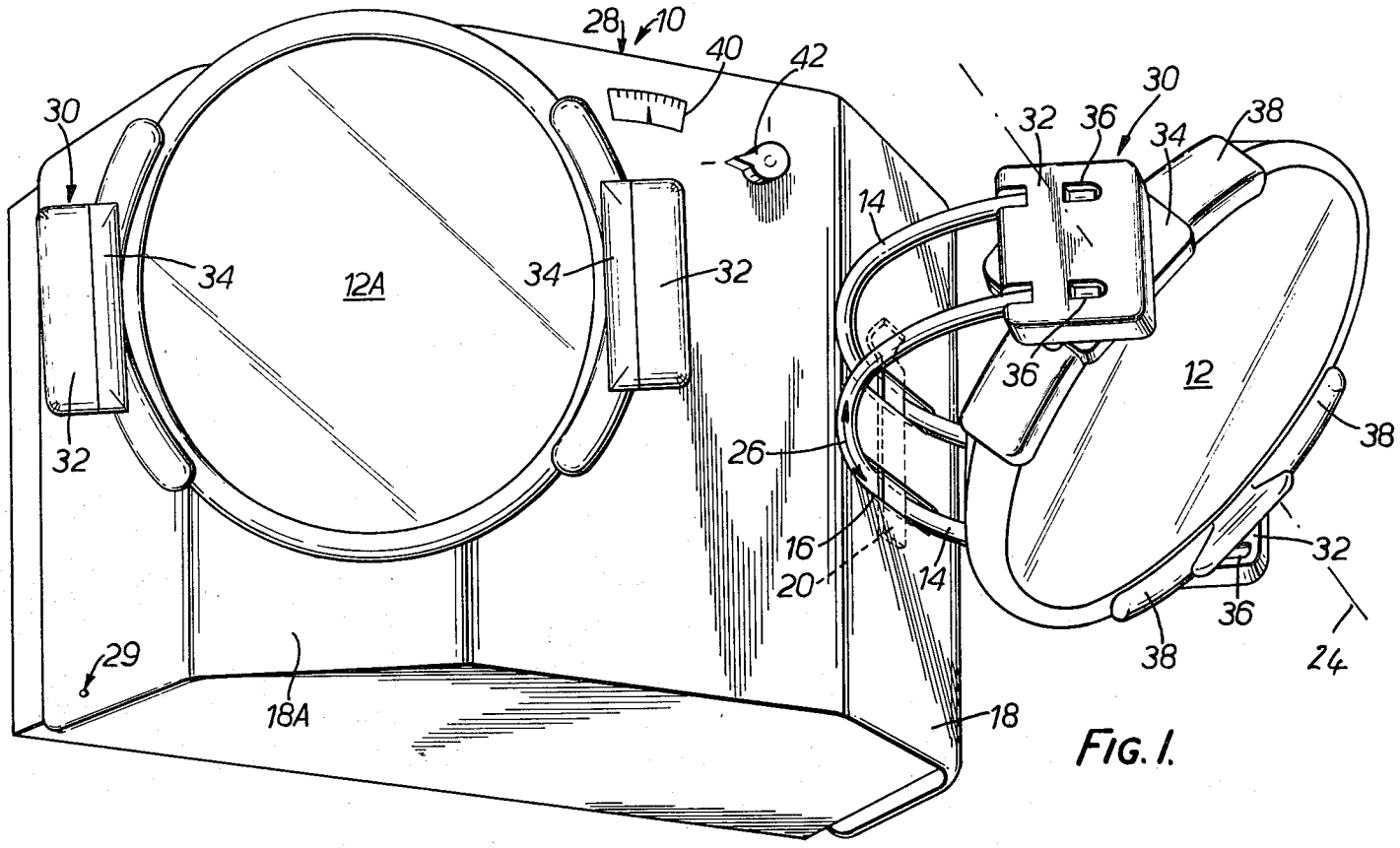
FIG. 1 is an isometric view of a sheet metal body 10 with two lamps 12, 12A mounted on it by pivot mountings according to the invention.

Each lamp is mounted on the body 10 by a pair of strong steel rods 14 of semi-circular arcuate shape. For convenience only the mounting for one lamp 12 is shown. The arcuate rods 14 each fit snugly in one of a pair of slots 16 formed in a face 18 of the body 10. The rods are retained in the slots 16 against the ends of the slots by a single resilient spring strip 20, which lies underneath the face 18, on either side of the slots, as shown in chain lines, and passes over the arcuate rods 14 where they lie in the slots 16. The strip 20 has to be sprung into position so that its resilience holds the rods against the ends of the slots. The rods can be adjusted against frictional spring restraint about a vertical axis containing the centres of the circular arcs, which axis intersects a horizontal pivot axis 24.

The arcuate rods are connected at either side of the lamp 12 to a housing 30, each end of a rod being located in a socket 36 of the housing. The distance between opposing sockets 36—each receiving an end of one rod—is such that the arcuate rod has to be flexed outwardly in order that each end of the rods may be inserted into a socket. Thus, when the arcuate rods are connected to the housings, the housings are biased towards each other, but are prevented from moving towards each other by the lamp 12. The lamp is mounted to turn about bearings in the housings 30 which define the pivot axis 24.

When the body 10 is mounted on a wall, for example, each lamp 12 can be rotated about its pivot axis 24, and the arcuate members 14 can slide in the slots 16, in the directions shown by the arrow 26, until the desired area is illuminated.

The lamp 12A is mounted on a face 18A of the body 10, the face 18A being in a different plane from the face 18, thus enabling a greater possible combination of illuminating positions to be achieved.

The housings 30 consist of the two parts 32 and 34, the parts 32 receiving the ends of the arcuate rods 14 in the sockets 36, and the parts 34 having extended arcuate arms 38 which partly extend around and partly surround the periphery of the lamp 12. As the arcuate rods 14 are flexed outwardly, the parts 32 are biased towards one another, and this presses the parts 34 against diametrically opposed parts of the periphery of the lamp 12 to help to retain the lamp between the housings 30.

The parts 32 and 34 are rotatable relatively to each other and are so dimensioned that, when they are in the position shown for the lamp 12A, their abutting surfaces completely cover each other.

Figure 2:
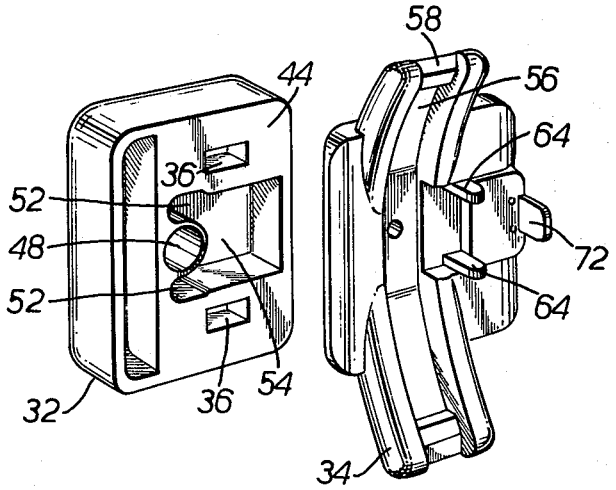
FIG. 2 is an expanded isometric view of two parts 32 and 34 which constitute a housing for the pivot mounting.
Figure 3:
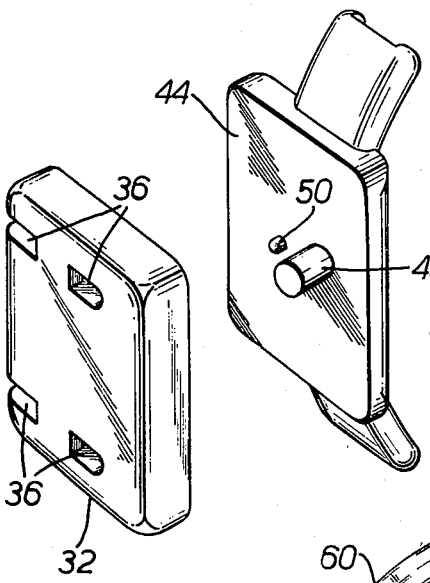
FIG. 3 is a similar view to FIG. 2 with the isometric view being taken from another direction.

FIGS. 2 and 3 show details of the parts 32 and 34. Abutting surfaces 44 of the two parts are cross-hatched, and the pivoting between the two members is provided by a journal 46, formed on the part 34, seating in a cylindrical recess 48 in the part 32, the walls of the recess 48 providing a bearing surface for the journal.

A spiggot 50 projects from the surface 44 of the part 34 so that as the parts 32 and 34 are rotated relatively to one another the spiggot 50 travels around in a cut out portion 54 around the recess 48, and limits the degree of relative rotation between the parts 32 and 34 by abutment at end points 52. The distance between the two points 52 is such that the parts 32 and 34 are able to rotate through just over 180° with respect to each other.

Each part 34 is integral with a pair of arcuate arms 38 which have a cross-section defining a channel 56 in which lies the periphery of the lamp 12. A step 58 is provided at each end of the channel 56.

Figure 4:
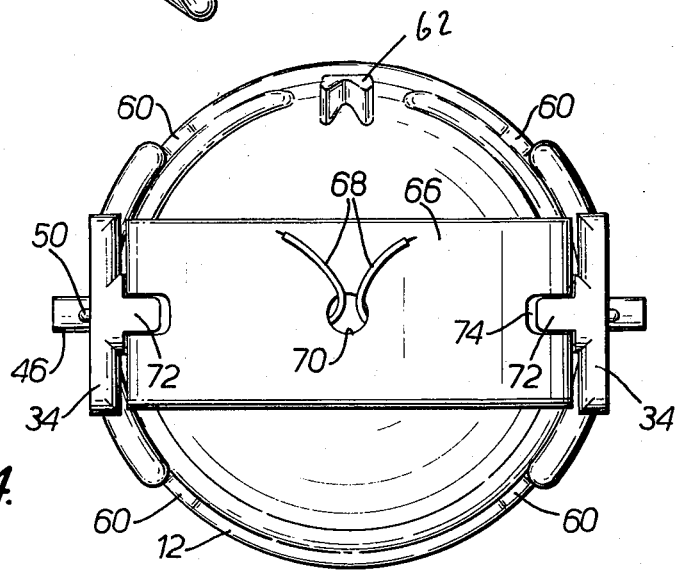
FIG. 4 is a rear view of the lamp 12 in FIG. 1.

As seen in FIG. 4, the rear surface of the lamp 12 is formed with a series of projections 60 and a further set of larger projections 62. The part 34 has two upstanding lugs 64 (see FIG. 2) which lie on either side of a larger projection 62 to prevent the part 34 from moving around the periphery of the lamp 12.

The projections 60 abut against the ends of the channel 56 to further retain the part 34 in its peripheral location.

FIG. 4 also shows an arcuate channel-shaped member 66 extending over the back of the lamp. The leads 68 from the lamp bulb project through a hole 70 in the channel-shaped member 66. The channel-shaped member 66 protects the terminals of the lamp and is retained in position by a lug 72 on each part 34 lying in a recess 74 formed in the corresponding end of the channel-shaped member 66.

The device is particularly useful for battery operated emergency lighting systems which are designed to operate as soon as the main supply fails.

The power for the lights comes from a battery housed inside the body 10, and the lamps are used to illuminate areas of particular importance, for example exits from a room or hazardous areas.

The body 10 carries a volt-meter 40 and an indicator switch 42.

Although the arrangement is very simple, requiring for each lamp only two rectangular slots in the face 18, the spring strip 20, and the housings into which the ends of the rods 14 fit, there is a wide range of positions of adjustment.

After removal of a screw at 28, the front of the body 10 can be pivoted downwards about a horizontal axis 29 in relation to the rest of the body to allow access to the battery.

There may be a casing concealing much of the rods 14 and the housings 30.

The components 32, 34, and 66 are plastics mouldings.

The assembly comprising a lamp 12, the pairs of bearing housing parts 32 and 34, and the member 66, is held together solely by the resilience of the spring rods 14. With these rods also comprising the means of pivotal attachment to the housing it will be apparent that a very simple and inexpensive arrangement is provided.

What is claimed as new and desired to be secured by Letters Patent of the United States is:

1. A pivot mounting for an object, comprising:

a pair of journal bearings having a common journal axis and being relatively movable along said axis, each said bearing comprising a journal component and a housing component, one of said components including an object gripping surface, wherein said object is gripped between said journal bearings by said gripping surfaces; and spring means urging said journal bearings towards one another along said journal axis, wherein said components are held together and said object is held between said gripping surfaces solely by the biasing of said spring means along said axis.

2. A mounting as claimed in claim 1 wherein said object is a circular object gripped between the gripping surfaces of the bearings.

3. A mounting as claimed in claim 1 in which the components of each journal bearing are moulded plastics components, one of which is molded with means for locating one end of the spring means.

4. A mounting as claimed in claim 3 in which one of the moulded plastics components includes co-operating portions which limit the relative rotation of the journal and the journal housing.

5. A mounting as claimed in claim 4 in which the relative rotation is limited to substantially 180°.

6. A mounting as claimed in claim 1 in which the gripping surfaces of the bearings are channel-shaped surfaces.

7. A pivot mounting as claimed in claim 1 in which the journal bearings include extension members which define the gripping means.

8. A mounting as claimed in claim 1 in which the bearings include engagement members for co-operating with the object to prevent the object rotating between the gripping members.

9. A mounting as claimed in claim 1 in which a cover extends between the bearings and is retained by the bearing against the object.

10. A mounting as claimed in claim 1 in which the spring means comprise at least one arcuate spring wires.

11. A mounting as claimed in claim 10 in which there are two parallel part-circular spring wires acting as a further pivot mounting about a second axis through the centre of the part-circles perpendicular to the planes of the part-circles.

12. A mounting as claimed in claim 1 in which the spring means are part-circular and are located against the ends of a slot, in a supporting member with means holding the spring means against the slot, the pivot axis being through the centre of the arc of the part-circular spring means perpendicular to the plane of the arc, and on the journal axis.

13. A lamp arrangement in which two lamps are pivotally mounted on a common body, each by means of a pivot mounting as claimed in claim 1.

14. A lamp arrangement as claimed in claim 13 in which two lamps are mounted on external faces of the body which lie in different planes.

15. A battery operated emergency lighting system including a lamp arrangement as claimed in claim 13 or claim 14.

* * * * *